United States Patent [19]

Franklyn

[11] 4,269,328

[45] May 26, 1981

[54] LINE MARKING MACHINE WITH HEATERS

[76] Inventor: Derek A. Franklyn, 12943-54A Ave., Surrey, British Columbia, Canada

[21] Appl. No.: 17,265

[22] Filed: Mar. 5, 1979

[30] Foreign Application Priority Data

Mar. 13, 1978 [CA] Canada ..... 298807

[51] Int. Cl.[3] ..... B67D 5/62

[52] U.S. Cl. ..... 222/146 H; 222/611; 118/415; 239/149; 239/172

[58] Field of Search ..... 239/149, 150, 172; 404/94; 118/413, 415; 222/608, 611, 164, 146 H

[56] References Cited

U.S. PATENT DOCUMENTS

| | | | |
|---|---|---|---|
| 1,083,030 | 12/1913 | Price | 239/149 |
| 1,923,632 | 8/1933 | MacRae et al. | 404/94 |
| 2,064,504 | 12/1936 | Thompson | 222/608 X |
| 3,070,822 | 1/1963 | Lipkins | 404/94 X |

*Primary Examiner*—David A. Scherbel

*Attorney, Agent, or Firm*—Fulwider, Patton, Rieber, Lee & Utecht

[57] ABSTRACT

A line marking machine having a carriage which an operator can push along a road or parking-lot surface. The carriage supports a hopper containing marking fluid. A discharge opening in the hopper is fitted with a gate which is actuated by a mechanism controlled by the operator. Near the discharge opening, the hopper has parallel lower edge portions which determine the width of the line applied to a surface. The thickness of the line is determined by the opening angle of the gate which controls the discharge rate of the fluid and also by the speed of advancement of the carriage.

3 Claims, 6 Drawing Figures

10
14
40
75
44
104
41
42
96
95
120
94
93
92
35
102
43
61
72
67
64
66
103
70
62
107
106
71
54
55
57
85
84
86
83
91
89
88
80
87
90
90A
82
47
46
5
68
58
59
50
125
114
110
112
23
28

LINE MARKING MACHINE WITH HEATERS

FIELD OF THE INVENTION

This invention relates to a machine for marking lines on road surfaces and the like.

DESCRIPTION OF THE PRIOR ART

Traffic lanes on roadways and vehicle slots in parking lots are commonly marked off by painted lines which soon become faded and worn to the extent that repainting is necessary. A solution to this time-consuming and costly maintenance problem is to use a durable plastic as a marking material and to make the lines much thicker than a normal painted line. The plastic material, of course, must be kept in a fluid state so that it can be flowed onto the road somewhat like an extremely thick coat of paint and the various applicators presently available for this purpose have been found unsuitable for the task. For example, one hand-operated applicator lays down lines which are not of uniform thickness and are marred by ragged side edges. Also the conventional applicator tends to drip plastic as it is moved from one area to another so that the whole line marking operation is messy and generally unsatisfactory.

SUMMARY OF THE INVENTION

The present invention overcomes the above mentioned as well as other disadvantages of conventional applicators by providing a machine which is capable of maintaining the molten plastic at the correct temperature to be applied smoothly and evenly to a surface. As the fluid material discharges from the machine onto a relatively cool road surface, the line is contained along its side edges long enough for the material to congeal so that those edges are clearly defined and free from unsightly trails of the marking material. The rate of discharge is readily controlled by the machine operator to ensure that lines of uniform thickness are quickly and accurately applied without spillage in the surrounding area.

More specifically, apparatus according to the present invention may be defined as a line marking machine for applying lines of demarkation to a road surface of the like which comprises a carriage adapted to be moved along said road surface, a hopper mounted on the carriage and adapted to contain a quantity of marking fluid, said hopper having adjoining walls arranged to provide a discharge opening through which the marking fluid can flow onto the road surface, gate means mounted on the hopper for opening and closing the discharge opening, operating means connected to the gate means for selectively positioning said gate means whereby to control the flow of marking fluid through the discharge opening, some of the adjoining walls having parallel lower edge portions disposed to the rear of the discharge opening in a position to limit the width of a line formed as the marking fluid is applied to the road surface.

BRIEF DESCRIPTION OF DRAWINGS

In drawings which illustrate a preferred embodiment of the invention.

DESCRIPTION OF THE PREFERRED EMBODIMENTS

Figures 1, 2:
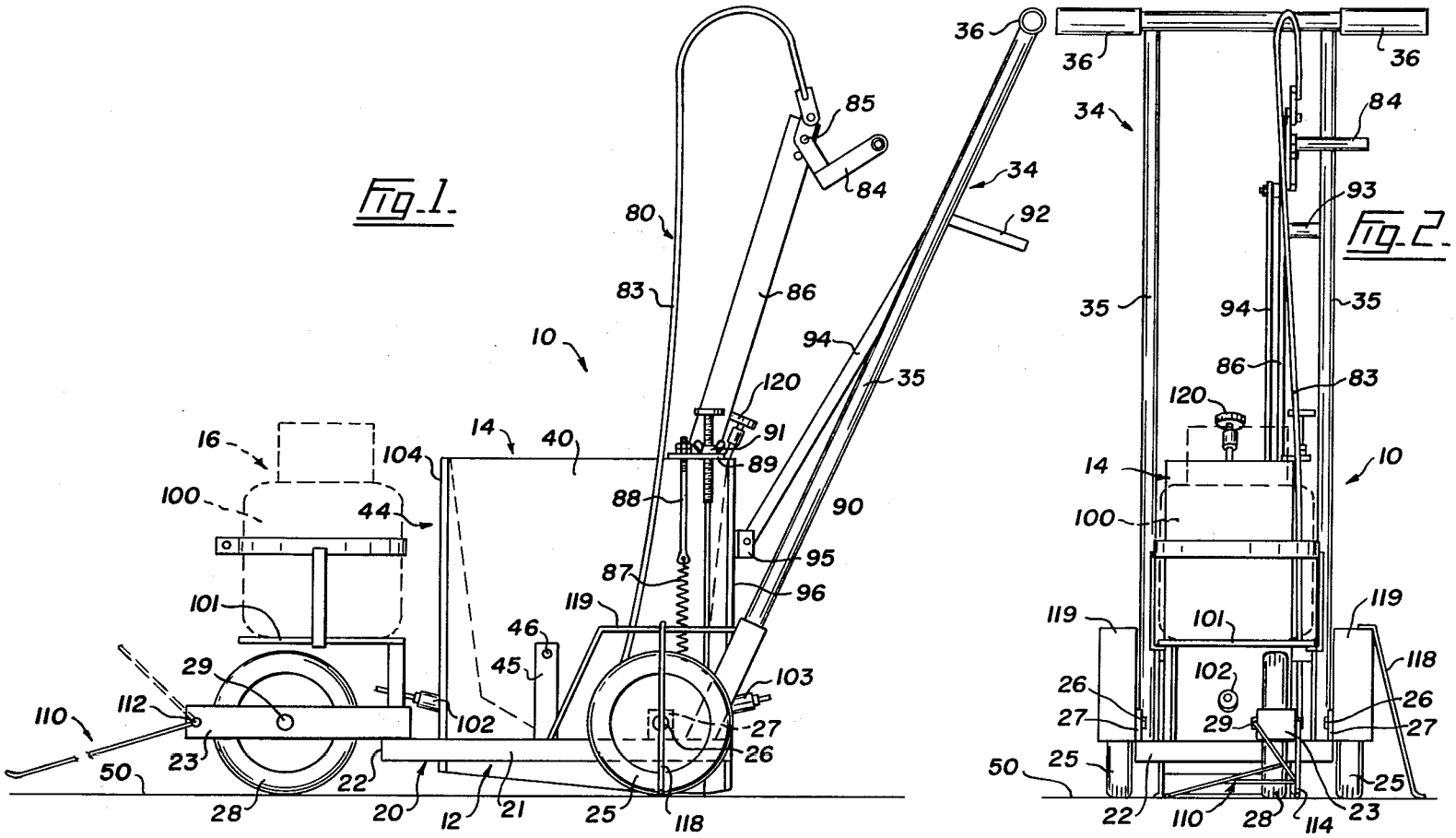
FIG. 1 is a side elevation of the present line marking machine with parts broken away.
FIG. 2 is a front elevation of the machine.

Referring to the drawings, the numeral 10 indicates generally a line marking machine constructed in accordance with the present invention. The machine comprises a wheeled carriage 12 which supports a hopper 14 for a liquid used to mark traffic lines on roads, parking lots, and elsewhere. Since the present machine is particularly intended for use in applying traffic lines to road surfaces, the preferred marking liquid is a suitable plastic material which must be kept at a high temperature so that it will flow freely from the hopper onto the road. For this purpose, the machine 10 carries its own heating system which is generally indicated at 16.

The carriage generally indicated at 12 will be seen in FIGS. 1 and 2 to comprise a frame 20 having transversely spaced side members 21, a front cross member 22 interconnecting the side members, and a pair of front forks 23 which project forwardly from the front cross member. Rear wheels 25 are mounted on laterally projecting spindles 26 which are carried by posts 27 mounted on the side members 21. A front wheel 28 is mounted on an axle 29 extending between the front forks 23, the front wheel being disposed to one side of the longitudinal axis of the frame as shown in FIG. 2. A rearwardly inclined handle 34 is secured to the rearmost end of the side members 21, this handle having tubular side members 35 and a handgrip 36. Thus, the carriage 12 can be conveniently wheeled along a road surface by a man walking and pushing the machine before him.

The hopper generally indicated at 14 is an open-topped structure having side walls 40, front and rear walls 41 and 42, and a bottom wall 43. A sheet metal casing 44 encloses the several walls of the hopper and is suitably secured thereto. The parallel side walls 40 are spaced apart to fit within the side members 21 of the frame. Posts 45 (FIG. 1) on the members 21 are fitted with inwardly projecting spindles 46, the inner ends of these spindles being rotatably received within sleeves 47 projecting laterally from the side walls 40. This arrangement provides the machine 10 with a mounting means which allows the hopper 14 to be rocked about the axes of the spindles 46 so as to move a hopper-carried part into and out of sliding contact with the surface of the road which is indicated by numeral 50 in the drawings.

Figures 3, 4, 5, 6:
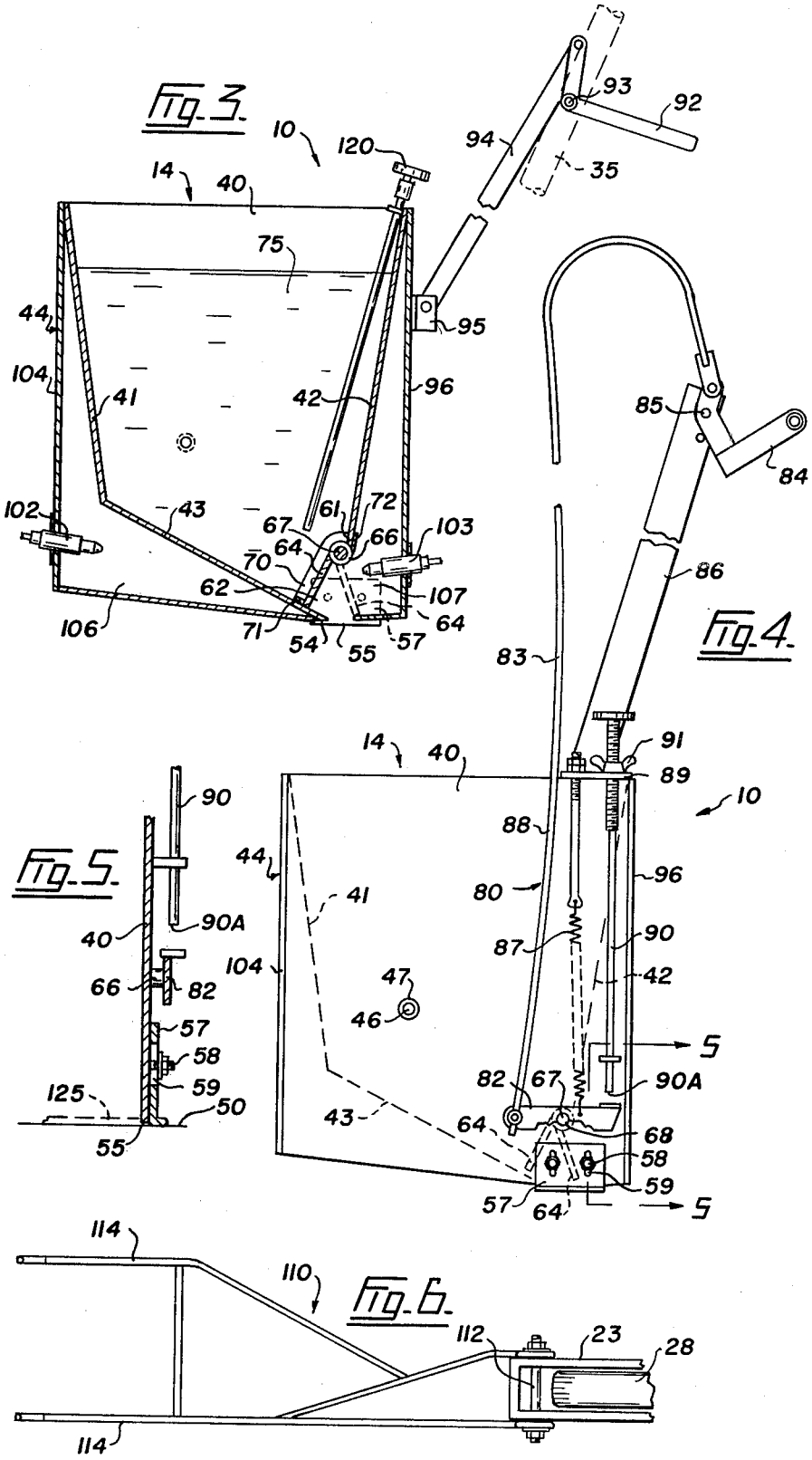
FIG. 3 is a an enlarged vertical section of a hopper on the machine.
FIG. 4 is a side elevation of the hopper.
FIG. 5 is a vertical section of the hopper taken on the line 5—5 of FIG. 4.
FIG. 6 is a plan view of a sighting bead provided on the machine.

The sloping bottom wall 43 has a bevelled lower edge 54, see FIG. 3, which is located in the same horizontal plane as lower edges 55 of the side walls. These edges 54 and 55 perform an important function during the spreading of the plastic marking material on the road surface and therefore the hopper is fitted with wear plates 57 which normally are in sliding contact with the road surface 50 (FIG. 5 only) when the machine is in use during a line-marking operation. As best shown in FIGS. 4 and 5, one such wear plate is secured to each side wall 40 by means of bolts 58. These bolts extend through vertical slots 59 formed in each plate to provide for vertical adjustment of the plate as wear occurs. Normally, the plates project below the edges 55 of the side wall about 1/64th of an inch to support those side walls edges a corresponding distance above the road surface 50.

Referring again to FIG. 3, the rear wall 42 will be seen to have a lower edge 61 which is spaced about edge 54 of the bottom wall so as to define with the latter edge and the side wall 40 a bottom discharge opening 62 for the flowable marking material. This discharge opening is adapted to be controlled as to size by a gate 64 which is substantially rectangular and has a cylindrical sleeve 66 extending along an upper edge thereof. Hinge pins 67 are secured within opposite ends of the sleeve 66 and these pins are rotatably received within bearing holes 68 (FIG. 4) formed in the side walls 40. The gate when closed seals against strips 70 and 71 secured to the inner surfaces of the walls 40 and 43 respectively, see FIG. 3. Another vertically adjustable strip 72 is mounted on the outer surface of the rear wall 42 to bear against the cylindrical sleeve 66 on the gate whereby to provide an additional sealing action along the upper edge of the gate. Thus, the hopper 14 can be filled with liquid marking material 75 to about the level indicated in FIG. 3 and that material can be dispensed through the opening 62 by manipulation of the gate 64.

The line marking machine 10 is provided with operating means 80 for controlling the position of the gate 64 within the opening 62. As shown best in FIG. 4, the means 80 comprises a lever 82 which is secured to the outwardly projecting end of one of the hinge pins 67. A flexible rod 83 connects one of this lever to an opposite end of a crank handle 84 which is secured by a pivot pin 85 to an arm 86, the arm projecting upwardly and rearwardly from the hopper. A spring 87 connects the lever 82 to a bolt 88 secured to a lug 89 carried by the hopper whereby to bias the gate towards the open position. The lug 89 is fitted with an adjusting bolt 90 the lower end of which provides a stop 90A for the adjacent end of the lever 82. Thus, the operator of the present machine can open and close the gate by operation of the means 80. The adjusting bolt 90, of course, is positioned so as to limit the extent to which the gate can be opened and a wing-type lock nut 91 is fitted to the bolt to secure it in adjusted position.

As previously mentioned, the hopper 14 is rockingly mounted so that the wear plates 57 can be swung into and out of contact with the road surface 50 as required. To position the hopper within it supporting frame in this manner, the machine 10 is provided with tilting means which will now be described. One of the side members 35 of the handle is fitted with a crank 92 (FIG. 3) which is secured to that handle member by a pivot pin 93. A bar 94 pivotally connects one end of this crank to a lug 95 secured to a rear wall 96 of the casing 44 enclosing parts of the hopper. By use of the crank 92, the machine operator can tilt the hopper forward slightly and thus raise the wear plates 57 up off the road surface as is desirable when the machine is being moved from place to place, or from one line to the next during a road-marking operation.

The heating system generally indicated at 16 comprises a propane tank 100, see FIGS. 1 and 2, which sits in a base 101 carried by the pair of front forks 23. This tank is fitted with the usual control valves as well as pipes and the like (not shown) leading to burners 102 and 103, see also FIG. 3. These burners are supported by a casing wall 104 sheet metal plates and the wall 96 of that casing. Some of the sheet metal plates are arranged to enclose the sloping front and bottom walls 41 and 43 whereby a front heating chamber 106. The burner 102 is supported by the casing wall to direct its flame into the front heating chamber 106. The casing 44 is also shaped to provide a rear heating chamber 107. The burner 103 is supported by the casing wall 96 to direct its flame into the chamber 107 in the vicinity of the gate 64.

The line marking machine is equipped with a sighting bead 110 which appears in FIGS. 1 and 2 but which is best illustrated in FIG. 6. Bead 110 is lightly constructed of metal rods and the rearmost end of the bead is pivotally secured to the front forks 23 by a horizontal and transversely extending pin 112. This arrangement allows the bead to be swung upwardly and rearwardly to an out-of-use position. The free end of the bead has parallel locating rods 114 which are spaced apart a distance slightly greater than the width of a line to be applied to the road surface.

Preferably, a pointer 118 is attached to a rear wheel fender 119 on one side of the machine and so as to extend downwardly to a point close to the road surface. The lowermost end of this pointer is located in a position relative to the discharge opening 62 whereby to provide the machine operator with an indication where a marked line stops when the gate is closed and also where a line will start when the gate is opened.

The hopper 14 desirably is fitted with a thermometer 120 which is mounted on the rear wall 42 to extend into the plastic material 75. Such an instrument allows the machine operator to periodically check the temperature of the marking material and thus ensure that it will flow freely.

In use, the container 14 is filled with a plastic marking material 75 which preferably is preheated to a temperature which will allow it to flow freely onto the road surface. The machine operator starts up the system 16 to activate the burners 102 and 103 to maintain that temperature and wheels the machine 10 to the area to be demarked into traffic lanes, cross walks and so on. The hopper 14 is centered over the previous faded line, or over a chalked line previously marked on the road surface. The hopper is lowered by means of the crank 92 so that the wear plates 57 contact the road surface. By tripping the lever 84, the operator opens the gate 64 and simultaneously pushes the machine forward at an appropriately slow and constant speed using the sighting bead 110 as a guide. The gate, being spring loaded, opens to its preset stop 90A provided by the bolt 90 to give the desired rate of flow whereupon the forward speed of the machine determines the thickness to the line being applied to the road surface. The fluid marking material flows over the edge 54 at the rate selected and onto the road surface. Since the road surface is relatively cool, the fluid material very quickly loses much of its ability to flow and it has been found that it is the lower edges 55 of the side walls which contain the applied material and serve to limit the width of the line and provide clearly defined side edges to that line. The numeral 125 in FIG. 5 indicates a line wiped onto the surface 50 by the present machine and here it will be seen that the marking material does not normally enter beneath the edges 55 to come into contact with the wear plates 57. Thus, by controlling the opening of the gate 64, as well as the speed of advance of the machine, a plastic line of a required thickness is readily applied to the road surface.

From the foregoing it will be apparent that a reasonably experienced operator can quickly and easily mark off traffic lines and the like using the present machine. The plastic lines last much longer than a thick coat of paint, for example, and of uniform width unlike many spray-painted lines. Furthermore, the machine does not leave unsightly trails of the marking material as it is moved from one line to another. The gate 64 closes against the sealing strips 70 and 71 to positively shut-off the flow of marking material through the discharge opening. The open position of the gate can be adjusted easily and accurately by use of the adjusting bolt 90. The spring 87 holds the lever 82 against the stop 90A to retain the gate in the open position and this retaining action is augmented by the appropriately shaped flexible rod 83 which exerts additional opening pressure upon the gate when the crank handle 84 is swung to the over center or open position.

I claim:

1. A line marking machine for applying lines of demarkation to a road surface or the like comprising:

a carriage adapted to be moved along said road surface;

a hopper mounted on the carriage and adapted to contain a quantity of marking fluid, said hopper having a sloping bottom and adjoining walls, said adjoining walls including a rear wall spaced from said bottom to define a discharge opening through which the marking fluid can flow onto the road surface, said hopper further having parallel lower edge portions disposed to the rear of said discharge opening in a position to limit the width of a line formed as the marking fluid flows onto the road surface;

gate means mounted on the hopper for opening and closing said discharge opening;

operating means connected to said gate means for selectively positioning said gate means whereby to control the flow of marking fluid through said discharge opening;

a casing having walls spaced from said bottom and said rear wall of said hopper to form a first heating chamber adjacent said bottom, and a second heating chamber adjacent said rear wall and said gate means; and heating means for heating the space within said heating chambers for maintaining the marking fluid located within said hopper and the marking fluid passing through said discharge opening within a predetermined temperature range.

2. A line marking machine according to claim 1 wherein said heating means comprises a pair of burners located in said first and second heating chambers, respectively, that one of said burners located in said second heating chamber being located immediately adjacent said gate means.

3. A line marking machine according to claim 1 wherein said adjoining walls of said hopper include a front wall extending upwardly of said bottom and forming a wall of said first heating chamber.

* * * * *